US006600960B1

(12) United States Patent
Keegan

(10) Patent No.: US 6,600,960 B1
(45) Date of Patent: Jul. 29, 2003

(54) BOILER SYSTEM IGNITION SEQUENCE DETECTOR AND ASSOCIATED METHODS OF PROTECTING BOILER SYSTEMS

(75) Inventor: Patrick J. Keegan, Van Nuys, CA (US)

(73) Assignee: Rheem Manufacturing Company, New York, NY (US)

( * ) Notice: Subject to any disclaimer, the term of this patent is extended or adjusted under 35 U.S.C. 154(b) by 582 days.

(21) Appl. No.: 09/591,125

(22) Filed: Jun. 9, 2000

Related U.S. Application Data

(62) Division of application No. 08/982,858, filed on Dec. 2, 1997.

(51) Int. Cl.[7] ..... G05B 11/01

(52) U.S. Cl. ..... 700/21; 700/274

(58) Field of Search ..... 700/274, 21, 23, 700/27, 79, 80, 292, 286, 282; 431/6

(56) References Cited

U.S. PATENT DOCUMENTS

| | | | | |
|---|---|---|---|---|
| 2,624,399 A | | 1/1953 | Thomson et al. | 431/24 |
| 3,074,471 A | | 1/1963 | Ludi | 431/15 |
| 3,265,112 A | | 8/1966 | Eckelberry et al. | 431/15 |
| 3,277,949 A | | 10/1966 | Walbridge | 431/46 |
| 3,423,158 A | | 1/1969 | Forbes | 431/46 |
| 3,554,680 A | | 1/1971 | Malavasi | 431/77 |
| 3,614,278 A | | 10/1971 | DiNeta, Jr. | 431/15 |
| 3,955,910 A | | 5/1976 | Matthews | 40/784 |
| 4,055,164 A | | 10/1977 | Wu-Heng | 431/16 |
| 4,190,414 A | | 2/1980 | Elmy | 43/46 |
| 4,298,334 A | | 11/1981 | Clark et al. | 700/27 |
| 4,412,328 A | | 10/1983 | Homa | 431/74 |
| 4,852,046 A | | 7/1989 | Jones et al. | 431/74 |
| 4,955,806 A | | 9/1990 | Grunden et al. | 431/24 |
| 4,976,605 A | | 12/1990 | Geary | 431/6 |
| 5,074,780 A | | 12/1991 | Erdman | 431/6 |
| 5,076,780 A | | 12/1991 | Erdman | 431/6 |
| 5,311,451 A | * | 5/1994 | Barrett | 700/278 |
| 5,364,260 A | | 11/1994 | Moore | 431/6 |
| 5,531,589 A | | 7/1996 | Williams | 431/6 |
| 5,551,419 A | | 9/1996 | Froehlich | 128/134 |
| 5,590,036 A | * | 12/1996 | Maeda | 700/79 |
| 5,624,551 A | | 4/1997 | Baumann et al. | 210/134 |
| 5,625,788 A | | 4/1997 | Boggs et al. | 712/214 |
| 5,630,325 A | | 5/1997 | Bahel et al. | 62/227 |
| 5,649,818 A | | 7/1997 | Day | 431/6 |
| 5,720,604 A | | 2/1998 | Kelly et al. | 431/6 |
| 5,791,890 A | | 8/1998 | Maughan | 431/6 |

FOREIGN PATENT DOCUMENTS

| | | |
|---|---|---|
| CA | 1183237 | 2/1985 |
| EP | 0573223 A1 | 12/1993 |

* cited by examiner

*Primary Examiner*—Albert W. Paladini
*Assistant Examiner*—Kidest Bahta
(74) *Attorney, Agent, or Firm*—Konneker & Smith, P.C.

(57) ABSTRACT

An event detector and associated methods of protecting systems provide convenient and economical safety features. In a described embodiment, an ignition sequence detector for a boiler system has a microprocessor which is programmed so that an ignition control module of the boiler system is deprived of primary power when an improper sequence of events occurs. The ignition sequence detector includes multiple event detectors interconnected to the microprocessor, and is configured so that it is usable in high RFI environments.

6 Claims, 3 Drawing Sheets

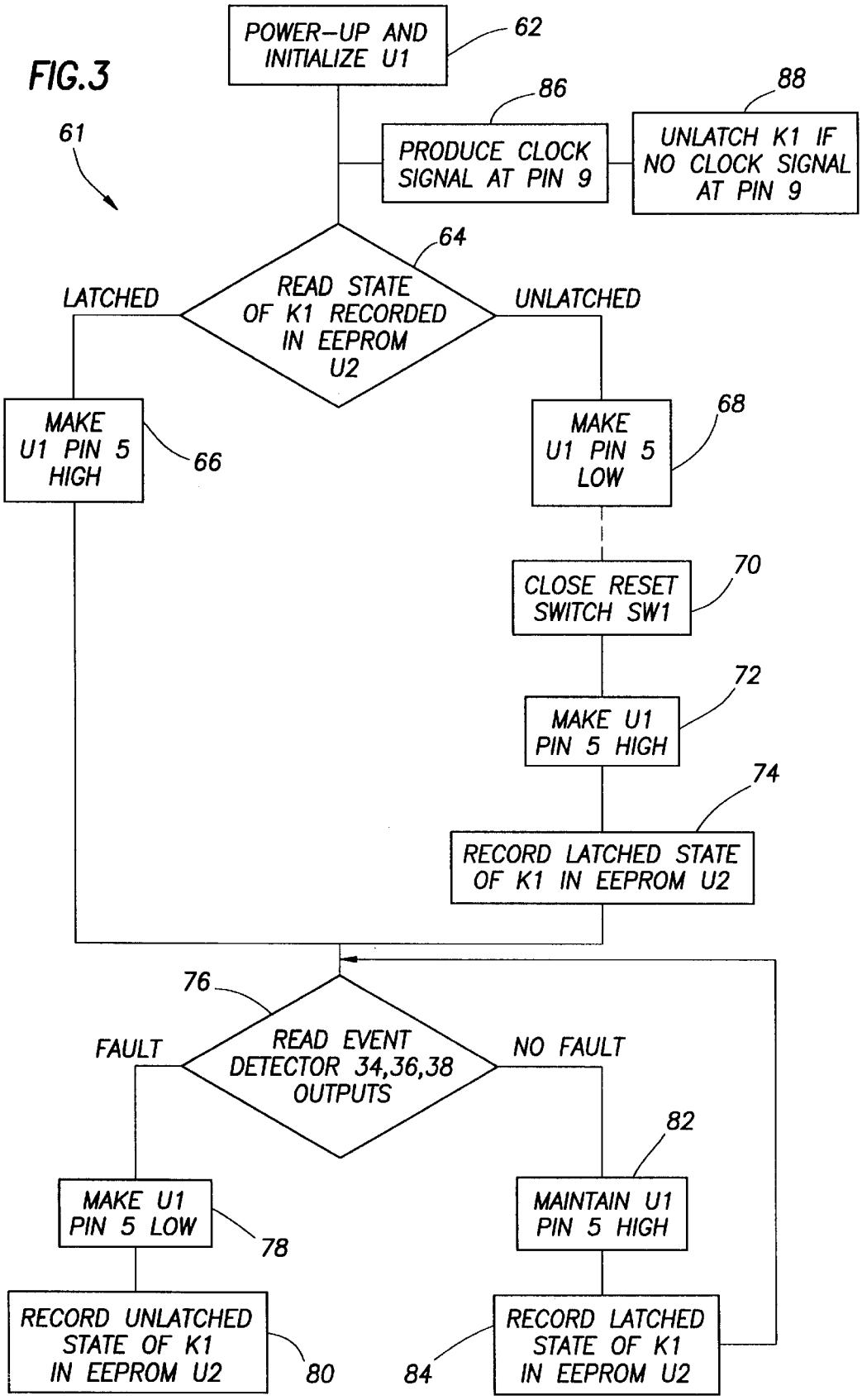
FIG.3
61
POWER-UP AND INITIALIZE U1
62
PRODUCE CLOCK SIGNAL AT PIN 9
86
UNLATCH K1 IF NO CLOCK SIGNAL AT PIN 9
88
READ STATE OF K1 RECORDED IN EEPROM U2
64
LATCHED
UNLATCHED
MAKE U1 PIN 5 HIGH
66
MAKE U1 PIN 5 LOW
68
CLOSE RESET SWITCH SW1
70
MAKE U1 PIN 5 HIGH
72
RECORD LATCHED STATE OF K1 IN EEPROM U2
74
READ EVENT DETECTOR 34,36,38 OUTPUTS
76
FAULT
NO FAULT
MAKE U1 PIN 5 LOW
78
MAINTAIN U1 PIN 5 HIGH
82
RECORD UNLATCHED STATE OF K1 IN EEPROM U2
80
RECORD LATCHED STATE OF K1 IN EEPROM U2
84

BOILER SYSTEM IGNITION SEQUENCE DETECTOR AND ASSOCIATED METHODS OF PROTECTING BOILER SYSTEMS

This is a division, of application Ser. No. 08/982,858, filed Dec. 2, 1997, such prior application being incorporated by reference herein in its entirety.

BACKGROUND OF THE INVENTION

The present invention relates generally to systems in which it would be desirable to detect events or sequences of events and, in an embodiment described herein, more particularly provides a boiler system ignition sequence detector.

In many electromechanical systems, or simply electrical or mechanical systems, an event or sequence of events should occur in the normal course of operation. However, if the event or sequence of events do not occur as desired, remedial or emergency operations may need to be performed to restore the system to normal operation. Thus, a detector which is able to indicate when an event or sequence of events does not occur as desired would be very useful in these circumstances.

In the case of a boiler system, a desired sequence of events may be as follows: fuel is supplied to the boiler system, electrical power is supplied to the boiler system, a pilot valve is opened, a flame is ignited at a pilot burner, a thermostat indicates a need for heat, a main valve is opened, a flame is ignited at a main burner, the thermostat indicates that additional heat is not needed, the main valve is closed, etc. Several of these events are typically controlled by an ignition control module of the boiler system. For example, the ignition control module may control when the pilot valve opens, ignition of the pilot flame, opening of the main valve, etc.

Hazardous conditions may result if an improper sequence of events occurs in a boiler system. For example, if the main valve is opened before the pilot valve is opened, fuel may accumulate within the boiler system and lead to uncontrolled burning or explosion. As another example, if the main valve is opened before the thermostat indicates a need for heat, the boiler may become overheated.

In the past, simple relays have been used to ensure that a proper sequence of events has occurred in a boiler system. In this manner, for example, power could not be supplied to a main solenoid valve unless power had been previously supplied to a pilot solenoid valve and the thermostat had previously indicated a need for additional heat. Unfortunately, such types of relay networks are easily fooled and may fail to react if a sequence of events, although improper, does not occur exactly as prescribed. Additionally, such event detectors usually were constructed with relatively large and expensive mechanical latching relays. Due to the high radio frequency transmissions produced by ignition of the pilot flame, construction of a generally solid state event detector was thought to be unfeasible.

From the foregoing, it can be seen that it would be quite desirable to provide an event detector for electrical, mechanical, electromechanical or electronic systems which is capable of accurately detecting the occurrence of an event or sequence of events in the system, and which is suitable for use in high RFI level environments. When used in a boiler system, it would be desirable for the event detector to further be able to shut down the boiler system if an improper event or sequence of events occurs, and for the event detector to maintain the boiler system in this state until it is manually reset. It is accordingly an object of the present invention to provide such an event detector and associated methods of protecting systems.

SUMMARY OF THE INVENTION

In carrying out the principles of the present invention, in accordance with an embodiment thereof, a latching event detector is provided which uses solid state technology, utilization of which does not require a network of mechanical relays, but which is usable in high RFI environments. Methods of protecting systems are also provided.

In broad terms, a latching event detector is provided which includes at least one event detector, each of which is interconnected to a corresponding element of a system, so that each detector is capable of indicating when an event has occurred for its corresponding element. The output of each event detector is interconnected to a microprocessor. The microprocessor is programmed and interconnected to the system, such that the system is disabled when an improper event or sequence of events occurs. The system can be subsequently enabled by manually resetting the latching event detector while primary power is applied thereto.

In the disclosed and described embodiment, the event detectors are interconnected to a pilot valve, a main valve and a thermostat of a boiler system. When an improper sequence of events occurs, an ignition control module of the boiler system is disabled by removing primary power therefrom, thereby removing power from the pilot and main valves. Primary power may be restored to the ignition control module by depressing a reset switch of the latching event detector while power is supplied thereto.

A method of protecting boiler systems is also provided, which method includes the steps of reading the recorded state of a relay and determining whether a fault has occurred by reading the outputs of one or more event detectors. If a fault is detected, the relay is unlatched and the unlatched state is recorded in an EEPROM. Upon subsequent power-up, if an unlatched state is recorded in the EEPROM, the relay may be latched only if a reset switch is closed.

These and other features, advantages, benefits and objects of the present invention will become apparent to one of ordinary skill in the art upon careful consideration of the detailed description of a representative embodiment of the invention hereinbelow and the accompanying drawings.

BRIEF DESCRIPTION OF THE DRAWINGS

FIG. 3 is a flow chart of a method of protecting boiler systems, the method embodying principles of the present invention.

DETAILED DESCRIPTION

Figure 1:
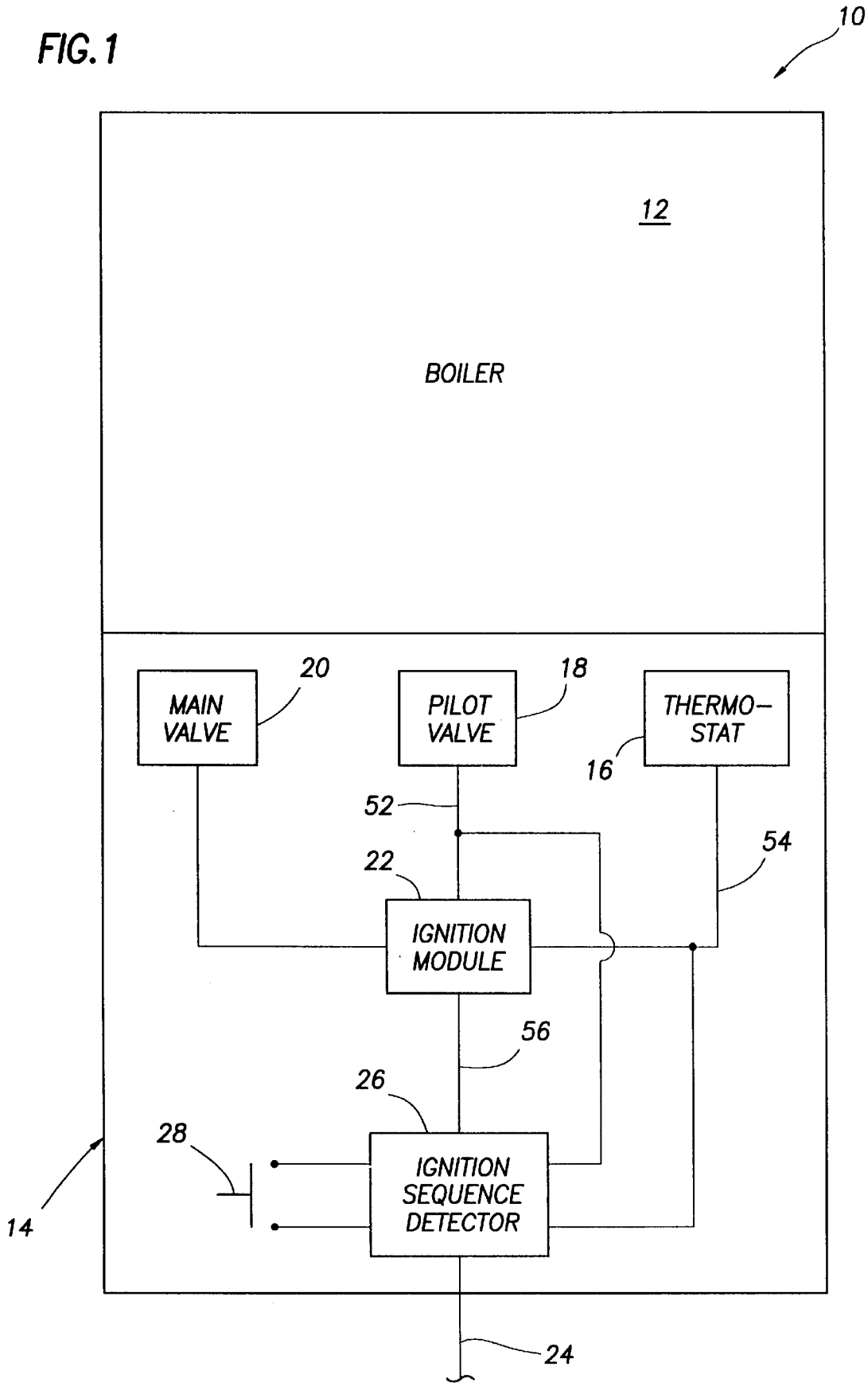
FIG. 1 is a schematic representation of a boiler system embodying principles of the present invention.

Representatively and schematically illustrated in FIG. 1 is a boiler system 10 which embodies principles of the present invention. The boiler system 10 is of the gas-fired type which is well known to those ordinarily skill in the art, in that it includes a boiler 12, a burner system 14 in close proximity to the boiler for providing heat to the boiler, and a thermostat 16 for regulating the temperature of the boiler. However, the burner system 14 described herein includes features not heretofore found in conventional burner assemblies.

The burner system 14 includes a conventional pilot valve 18 for regulating the supply of gas to a boiler pilot (not shown). The burner system 14 also includes a conventional main valve 20 for regulating the supply of gas to a main burner (not shown). In operation, the pilot valve 18 is typically open, thereby supplying gas to the boiler pilot continuously.

The main valve 20 is typically opened only when the thermostat 16 indicates that heat needs to be provided to the boiler 12. When the main valve 20 is opened, a relatively large quantity of fuel (as compared to that supplied to the boiler pilot) is supplied to the main burner, and this fuel is ignited by a flame of the boiler pilot. Thus, it will be readily appreciated that it would be very hazardous for the main valve 20 to be opened while the pilot valve 18 is closed, or while the pilot valve is open and a flame has not been ignited at the boiler pilot. For example, either of these situations could lead to accumulation of a large quantity of fuel within the burner system 14, which fuel might be inadvertently ignited and produce an uncontrolled explosion or other combustion of the fuel.

In the burner system 14, opening and closing of the pilot and main valves 18, 20, and ignition of a flame at the boiler pilot is controlled using a conventional ignition module 22. The ignition module 22 is interconnected to the pilot valve 18, main valve 20, and to the thermostat 16. Power is supplied to the ignition module 22 via a power line 24 supplying, for example, 24 VAC.

In conventional operation, when power is initially supplied to the ignition module 22 by the power line 24, such as when the boiler system 10 is turned on, the ignition module opens the pilot valve 18 and supplies a spark at the boiler pilot to ignite a flame at the boiler pilot. Thereafter, when the thermostat 16 indicates that heat needs to be supplied to the boiler 12, the ignition module 22 opens the main valve 20.

In an important aspect of the present invention, the burner system 14 further includes an ignition sequence detector 26, in order to protect the boiler system 10 from an improper ignition sequence. The ignition sequence detector 26 is interconnected to the power line 24, the thermostat 16, and to the pilot valve 18 at their interconnections to the ignition module 22. In this manner, the ignition sequence detector 26 is capable of monitoring whether a proper sequence has occurred, or whether a hazardous situation may be presented.

If a fault in the ignition sequence is detected by the ignition sequence detector 26, the ignition sequence detector will prevent power from being supplied to the ignition module 22 by the power line 24. In addition, the ignition sequence detector 26 will remain latched in this state, even if power is removed from the power line 24 and then restored. When latched to prevent power from being supplied to the ignition module 22, the ignition sequence detector 26 will subsequently permit power to be supplied to the ignition module only if it is manually reset while power is present on the power line 24, for example, by depressing a switch 28 connected to the ignition sequence detector.

Figure 2:
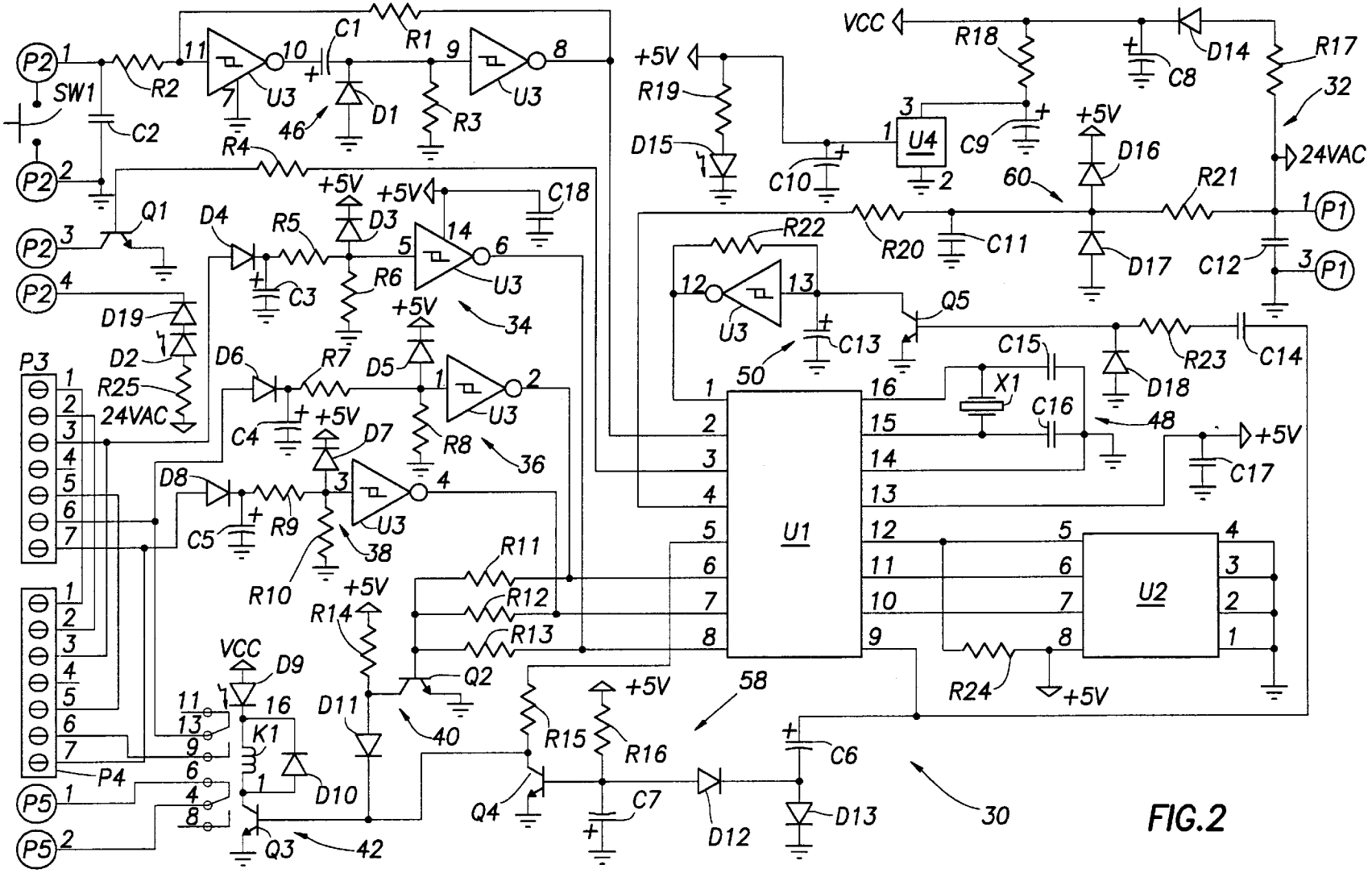
FIG. 2 is a circuit diagram of a latching event detector embodying principles of the present invention, the latching event detector being incorporated as an ignition sequence detector in the boiler system of FIG. 1.

Referring additionally now to FIG. 2, a circuit diagram of a latching event detector 30 embodying principles of the present invention is representatively illustrated. The latching event detector 30 is described herein as it may be used for the ignition sequence detector 26 of the boiler system 10 described above. However, it is to be clearly understood that the latching event detector 30 may be used in other systems, and other types of systems, without departing from the principles of the present invention.

The latching event detector 30 includes a power supply circuit 32, a programmable microprocessor U1, three event detector circuits 34, 36, 38, a relay K1, interconnected relay driver circuits 40, 42, a reset switch SW1, a single shot circuit 46, a clock circuit 48, and a watchdog circuit 50. The power supply circuit 32 receives primary power from the power line 24 at terminals 1 and 3 of a connector P1. The clock circuit 48 provides the basic system clock at pins 15, 16 of the microprocessor U1.

The event detector circuit 34 is connected to terminal 3 of a connector P3, which is connected to a line 52 connected between the ignition module 22 and the pilot valve 18. Voltage present on terminal 3 of connector P3 provides an indication that the pilot valve 18 is open, and the output of the event detector circuit 34 (at pin 6 of U3) will be low. When voltage is not present on terminal 3 of connector P3, the pilot valve 18 is closed, and the output of the event detector circuit 34 will be high. The output of the event detector circuit 34 is connected to pin 8 of the microprocessor U1, and to the base of transistor Q2 of the relay driver 40.

The event detector circuit 36 is connected to terminal 6 of the connector P3, which is connected to a line 56 for supplying power to the ignition module 22. Voltage present on terminal 6 of the connector P3 provides an indication that primary power is available for supply to the ignition module 22, and the output of the event detector circuit 36 (at pin 2 of U3) will be low. When voltage is not present on terminal 6 of connector P3, primary power has been lost, and the output of the event detector circuit 36 will be high. The output of the event detector circuit 36 is connected to pin 6 of the microprocessor U1, and to the base of transistor Q2 of the relay driver 40.

The event detector circuit 38 is connected to terminal 7 of the connector P3, which is connected to a line 54 connected between the thermostat 16 and the ignition module 22. Voltage present on terminal 7 of the connector P3 provides an indication that a switch of the thermostat is closed, and the output of the event detector circuit 38 (at pin 4 of U3) will be low. When voltage is not present on terminal 7 of connector P3, the thermostat switch is open, and the output of the event detector circuit 38 will be high. The output of the event detector circuit 38 is connected to pin 7 of the microprocessor U1, and to the base of transistor Q2 of the relay driver 40.

Note that an output of each of the event detectors 34, 36, 38 is connected to the relay driver 40. If any one of the event detectors 34, 36, 38 indicates a fault, transistor Q2 will conduct, thereby disconnecting ground from the power supplied (between VCC and ground) to the relay K1. When the relay K1 is no longer powered (i.e., "unlatched"), the 24 VAC power source on terminal 6 of a connector P4 (connected to K1 pin 9) is no longer electrically connected to terminal 6 of the connector P3 (connected to K1 pin 13), which is connected to the line 56 for supplying power to the ignition module 22. Thus, when any one of the event detectors 34, 36, 38 indicates a fault, the burner assembly 14 is disabled by unlatching the relay K1, and the pilot and main valves 18, 20 will be closed, thereby preventing a potentially hazardous accumulation of fuel. Pins 4 & 6 of K1 are connected to terminals 1 & 2 of a connector P5, which may optionally be used as an external indicator of the state of K1, such as by connecting the terminals to the contacts of an external relay (not shown).

As used herein, the term "latched" is used to indicate that power is supplied to the relay K1 by the latching event detector 30 circuits, transistor Q3 is conducting, and thereby connecting K1 pins 9 and 13 (as well as pins 4 and 8) and supplying power to the ignition module 22. The term "unlatched" is used to indicate that power is not supplied to the relay K1 by the latching event detector 30 circuits, transistor Q3 is not conducting, and power is not supplied to the ignition module 22.

The outputs of the event detectors 34, 36, 38 are also connected to terminals 6, 7 and 8 of the microprocessor U1. The microprocessor U1 is programmed, using conventional methods well known to those of ordinary skill in the art, to detect when certain sequences of events occur, and to produce certain outputs when corresponding detected sequences do occur. For example, if the ignition module 22 is powered (24 VAC is present at terminal 6 of connector P3), and the thermostat 16 switch is closed (24 VAC is present at terminal 7 of connector P3), but the pilot valve 18 goes from on to off (24 VAC is present, and then removed from terminal 3 of connector P3), the microprocessor U1 program will cause its pin 5 to go from high to low, thereby unlatching the relay K1 and disabling the burner system 14. This is due to the fact that the microprocessor U1 pin 5 is connected to the base of transistor Q3 of the relay driver 42. Note that the microprocessor U1 program can also cause its terminal 9 to go high, thereby causing transistor Q4 to conduct, to thereby unlatch the relay K1.

Terminals 3 & 4 of the connector P2 may be connected to an external LED (not shown) for providing an external indication that a fault has occurred. For this purpose, the microprocessor U1 program causes its pin 3 to go high when a fault has been detected, thereby causing transistor Q1 to conduct. An internal indication is provided by an LED D2. The external indication is optional, and the internal indication may still be provided, even if no external indication is desired, by directly connecting terminal 3 to terminal 4 of the connector P2.

The microprocessor U1 is connected to a conventional EEPROM U2, which records when the relay K1 has been latched and unlatched. The microprocessor U1 is, thus, able to "remember" the state of the relay K1. In the event that power supplied to the latching event detector 30 is interrupted, the microprocessor U1 will have the state of the relay K1 in its memory when the power is restored.

In order to reset the relay K1 from its unlatched to its latched state, the switch SW1 is momentarily depressed while primary power is being supplied to the latching event detector 30 on line 24. Closing of the switch SW1 causes the single shot circuit 46 to output a pulse to the microprocessor U1 at its pin 2. The EEPROM U2 is made to record a latched state of the relay K1 when the pulse is received by the microprocessor U1. The microprocessor U1 program makes pin 3 go high if the EEPROM U2 has a latched state of the relay K1 recorded on initial power-up, that is, when primary power is initially supplied on line 24.

The watchdog circuit 50 outputs a low frequency signal to pin 1 of the microprocessor U1. Pin 1 is the reset pin of the microprocessor U1.

The microprocessor U1 is programmed to produce a 1 KHz clock signal on its pin 9, which pulses the base of a transistor Q5, causing it to discharge a capacitor C13 and hold the output on pin 12 of U3 high. This clock signal is coupled through a capacitor C6 to a network 58. The network 58 produces a negative voltage from the clock signal, which is connected to the base of a transistor Q4. The negative voltage holds the transistor Q4 off, thereby allowing the signal on pin 5 of the microprocessor U1 to drive the base of the transistor Q3 of the relay driver 42.

If the microprocessor U1 fails, or its program otherwise fails to execute properly, the 1 KHz clock signal will no longer be present on its pin 9. Lack of the clock signal on pin 9 will cause Q4 to conduct (the junction of R16 and C7 no longer being held low), thereby preventing the transistor Q3 from conducting, and unlatching the relay K1. Thus, the network 58 provides "fail safe" operation of the microprocessor U1, i.e., if the microprocessor fails, the relay K1 is unlatched.

When power is first supplied on Line 24, the relay K1 is unlatched and no power is supplied to terminal 6 of the connector P3. Thus, no power is supplied to the ignition module 22 on line 56. There are no signals input to the event detectors 34, 36, 38, so their outputs are all high. The transistor Q2 of the relay driver 40 is turned on, pulling the anode of diode D11 low and disconnecting resistor R14 from the base of transistor Q3 of the relay driver 42. At this point, only the signal on pin 5 of the microprocessor U1 can turn the relay K1 on, and pin 5 will go high only when the microprocessor's program causes it to go high based on the data recorded in the EEPROM U2. If the microprocessor U1 fails to operate properly, for example, if it fails to execute its program, the outputs of the event detectors 34, 36, 38 will still hold transistor Q3 off. Thus, on initial power-up, pin 5 is high if a latched state of the relay K1 is recorded in the EEPROM U2, and pin 5 is low if an unlatched state of the relay K1 is recorded in the EEPROM.

A circuit 60, including diodes D16, D17, resistors R20, R21 and capacitor C11 produces a 60 Hz clock signal. This clock signal is input to the microprocessor U1 at its pin 4. Reading of the event detector circuit outputs at pins 6, 7, 8 is controlled by the clock signal, as is the switching of the signal on pin 5. In this manner, the detector 30 is "debounced" and false triggering due to noise is prevented. Such noise may be produced by a large quantity of RFI generated by a high voltage arc at the boiler pilot as the ignition module 22 attempts to ignite a flame. The wiring interconnecting the ignition module 22 and the latching event detector 30 carries this RFI to the latching event detector. Without the 60 Hz clock signal produced by the circuit 60, the relay K1 would chatter due to the noise disturbing the proper functioning of the microprocessor U1.

Thus, in a normal operating state of the boiler system 10, all three event detectors 34, 36, 38 produce low outputs, which are input at pins 8, 6, 7, respectively of the microprocessor U1. Transistor Q2, therefore, is nonconducting and the relay K1 may be latched on by current flow through resistor R14.

If any one of the inputs to the event detectors 34, 36, 38 is turned off, that is, if primary power is disconnected from the ignition module 22, the pilot valve 18 is closed, or the thermostat 16 switch opens, the base of Q2 is powered and the junction of R14 and D11 is pulled low. At this point, the microprocessor U1 program produces appropriate output, based on which of the inputs on its pins 6, 7, 8 are high and which are low, and the order in which they changed. For example, if the thermostat 16 switch cycles from closed to open, while the ignition module 22 remains powered and the pilot valve 18 remains open, Q2 will conduct, but the output on pin 5 of U1 will remain high and the relay K1 will remain latched.

If, however, the microprocessor U1 program detects a "fault", i.e., an improper event or sequence of events at its inputs 6, 7, 8, the program will cause the output on pin 5 of U1 to go low, thereby unlatching the relay K1. Additionally, the program will write an "unlatched" state of the relay K1 to the EEPROM U2.

The following is an example of an improper sequence of events, which may be detected as a fault by the microprocessor U1 program. With the boiler system 10 in its normal operating state, K1 is latched and power is supplied to the ignition module 22 at terminal 6 of connector P3. With the thermostat 16 switch closed, power is supplied to terminal 7 of connector P3 and to the thermostat input of the ignition module 22 on line 54. The ignition module 22 supplies power to the pilot valve 18 on line 52, which is also connected to terminal 3 of connector P3. If the ignition module 22 fails to sense a flame at the pilot burner, it turns off the power to the pilot valve 18. When the microprocessor U1 senses this sequence of events, the program causes the output on its pin 5 to go low, thereby unlatching the relay K1. The program also writes this unlatched state in the EEPROM U2.

When power is initially applied at terminals 1 & 3 of connector P1, transistor is nonconducting and, therefore, transistor Q3 is nonconducting and relay K1 is unlatched. No power is supplied to any of the event detector 34, 36, 38 inputs, so transistor Q2 conducts and resistor R14 is effectively disconnected from the base of transistor Q3. The microprocessor U1 reads the EEPROM U2 and determines whether pin 5 of U1 should be high or low (based on whether the relay K1 was latched or unlatched at power-down as recorded in the EEPROM; the actual state of relay K1 is irrelevant). The microprocessor U1 also produces the 1 KHz clock signal on its pin 9, thereby making transistor Q4 nonconducting. Thus, if U1 pin 5 is high, relay K1 turns on and power is supplied to connector P3 terminal 6, powering the ignition module 22 and making the output of event detector 36 low. When the ignition module 22 supplies power to the pilot valve 18, the output of event detector 34 goes low. When the thermostat 16 switch closes, the output of event detector 38 goes low. With all three of the event detectors 34, 36, 38 having low outputs, Q2 is nonconducting and resistor R14 is effectively connected to the base of transistor Q3. As long as all three outputs of the event detectors 34, 36, 38 are low (as is the case in the normal operating state of the boiler system 10), Q2 remains nonconducting and the base of transistor Q3 remains powered, even though normal operation of the microprocessor U1 may be momentarily interrupted, for example, by RFI generated when the ignition module 22 generates an ignition spark at the pilot burner.

Referring additionally now to FIG. 3, a method 61 of protecting the boiler system 10 is schematically illustrated. In step 62, power is initially supplied to the latching event detector 30 and the microprocessor U1 is initialized (i.e., a programmed reset or initialization program is executed). The latched or unlatched state of the relay K1 is then read from the EEPROM U2. If a latched state of the relay K1 is recorded, U1 pin 5 is caused to go high in step 66, and the method 61 proceeds to step 76.

If an unlatched state of the relay K1 is recorded in U2, U1 pin 5 is made to go low, and the method 61 will proceed no further unless the reset switch SW1 is closed. Thus, if the EEPROM U2 records an unlatched state of the relay K1, merely turning the power off and then back on will not result in the relay K1 being latched. In step 70 the reset switch SW1 is closed, causing U1 pin 5 to go high in step 72, and causing the EEPROM U2 to record a latched state of the relay K1 in step 74. The method 61 then proceeds to step 76.

In step 76 the outputs of the event detectors 34, 36, 38 are read at U1 pins 6, 7, 8. If a fault is detected, U1 pin 5 is made to go low in step 78 and an unlatched state of the relay K1 is recorded in the EEPROM U2 in step 80. If no fault is detected in step 76, U1 pin 5 is maintained high in step 82 and the latched state of the relay K1 is recorded or maintained in the EEPROM U2 in step 84. Periodically, the outputs of the event detectors 34, 36, 38 are again read, so that any subsequent fault will be detected and, in the event of a fault, the relay K1 will be unlatched and the unlatched state recorded in the EEPROM U2.

In parallel with the fault detection routine, a clock signal is produced at U1 pin 9 in step 86. If the clock signal is not present on U1 pin 9, the fail-safe network 58 causes the relay K1 to unlatch in step 88. Subsequent power-downs and power-ups will not cause the relay K1 to latch, as long as there remains no clock signal at U1 pin 9.

Of course, a person of ordinary skill in the art would find it obvious to make modifications, additions, deletions, substitutions, and other changes to the boiler system 10, latching event detector 30, and method 61. Accordingly, the foregoing detailed description is to be clearly understood as being given by way of illustration and example only, the spirit and scope of the present invention being limited solely by the appended claims.

What is claimed is:

1. A method of protecting a system from a malfunction of the system, comprising the steps of:

interconnecting a device with the system, the device having at least first and second states, the device protecting the system from the malfunction, by preventing operation of the system, when the device is in the second state;

interconnecting a plurality of event detectors to a corresponding plurality of components of the system;

periodically reading outputs of the event detectors to determine whether the malfunction, as indicated by a failure of the outputs to be generated in a predetermined sequence thereof, has occurred;

configuring the device to its second state in response to a determination that the malfunction has occurred; and recording the state of the device.

2. The method according to claim 1, wherein the periodically reading step is performed by a microprocessor coupled to the plurality of event detectors and to the device, the microprocessor being programmed to configure the device in response to the event detector outputs.

3. The method according to claim 2, further comprising the steps of monitoring operation of the microprocessor, and configuring the device to its second state in response to improper operation of the microprocessor.

4. The method according to claim 3, wherein the microprocessor monitoring step is performed by a circuit coupled to an output of the microprocessor and to the device.

5. The method according to claim 1, further comprising the step of coupling the outputs of the plurality of event drivers to a first device driver, the first device driver being coupled to the device.

6. The method according to claim 5, further comprising the step of supplying power from the first device driver to a second device driver interconnected between the first device driver and the device in response to a predetermined combination of the outputs of the plurality of event drivers.

* * * * *